US005435021A

United States Patent [19]

Williams

[11] Patent Number: 5,435,021

[45] Date of Patent: Jul. 25, 1995

[54] SHOWER WALL LINER

[76] Inventor: James Williams, 12 Fred St., Burlington, Mass. 01803

[21] Appl. No.: 138,987

[22] Filed: Oct. 21, 1993

[51] Int. Cl.[6] ..... A47K 3/02

[52] U.S. Cl. ..... 4/580; 4/614; 4/DIG. 18; 428/209

[58] Field of Search ..... 4/580, 559, 605, 612, 4/614, DIG. 18; 428/209

[56] References Cited

U.S. PATENT DOCUMENTS

| | | | |
|---|---|---|---|
| 2,274,765 | 3/1942 | Zalkind | 428/209 X |
| 3,582,452 | 6/1971 | Britton | 428/209 |
| 4,403,010 | 9/1983 | Festag et al. | 428/209 X |
| 4,550,455 | 11/1985 | Carson et al. | 4/483 X |
| 4,789,692 | 12/1988 | Rei et al. | 523/122 |
| 5,003,647 | 4/1991 | Williams | 4/580 X |

*Primary Examiner*—Robert M. Fetsuga

[57] ABSTRACT

An open bottom shower wall liner, adapted to be removably placed over the walls above a tub or the walls of a shower stall, which uses a structurally rigid contained framework, collectively formed from an "L-shaped" bottom reinforcing member which is rigid and one or more three-dimensional corner members which are structurally strong, and where, said structurally rigid contained framework is attached to a limp and flimsy, elastic and extensible polyolefin film. The structurally rigid contained framework collectively made by first dead-folding a metal foil, of sufficient thickness and width, into an "L-shaped" bottom reinforcing member which is rigid, and then second, further folding portions of this "L-shaped" bottom reinforcing member into three-dimensional corner members that are structurally strong, prevents the lower portions of this liner from billowing away from shower walls, moving from side to side, and partially clinging to the skin of the person showering, when lower portions of the liner are affected by forces on the inside of the shower enclosure.

11 Claims, 3 Drawing Sheets

SHOWER WALL LINER

FIELD OF THE INVENTION

This invention concerns a removable liner for shower walls, which by use of an attached, structurally rigid contained framework, collectively formed from an "L-shaped" bottom reinforcing member which is rigid, and one or more three-dimensional corner members which are structurally strong, eliminates billowing, shifting side to side movement, and clinging to the skin of a long and tall, limp film, shower wall liner, when lower portions of the liner are affected by forces on the inside of the shower enclosure when the shower is operating.

SUMMARY OF THE INVENTION

This invention relates to an open bottom shower wall liner that is removably attached to the upper walls above a tub, or the walls of a shower stall, which uses a structurally rigid contained framework to eliminate billowing, shifting sideways motion, and clinging of the lower portions of this liner to the skin. The structurally rigid contained framework is collectively produced when a foil, of sufficient thickness and width, is first latitudinally dead-folded into an "L-shaped" bottom reinforcing member that is rigid, and then second, corner folded into one or more three-dimensional corner members which are structurally strong. When these two physical structures are used together, they form a structurally rigid contained frame which overcomes three-dimensional forces, rotational forces, and forces in the x, y and z directions, which exist on the inside of the shower enclosure and affect the lower portions of this liner.

BACKGROUND AND PRIOR ART

There are a variety of shower curtain and tub liner patents which concern themselves with a fastening means to secure the top, bottom or sides of a sheet. As is shown below however, none of these patents solved the problems which result along the lower portions of a limp film, shower curtain. i.e., the film billowing away from the shower walls, shifting sideways when contacted, and clinging to skin of the person, when affected by forces on the inside of the shower.

A patent that pertains to a fastening method is U.S. Pat. No. 4,088,174 (Edwards) Shower Curtain Anchor Attachment, that attacks the inherently negative properties of a limp shower curtain with a complicated anchoring device which guides the lower edge of this shower curtain by means of a track system. Edwards' reference retains the shower curtain through two, circular snap apart discs. This disc cover has a centrally-oriented protuberance that is perpendicular to the disc cover and the disc body and perpendicular to the back wall. Essentially, Edwards has constructed a flexible shower door, which, (while effective for its purpose), did not solve billowing problems that are inherent in limp film shower curtains. The need for a solution to the billowing and sideways moving, clinging shower curtain remained unmet.

U.S. Pat. No. 3,365,684 (Stemke) Shower Curtain Retaining Means; is a series of magnetic mountings used to secure and retain the edge of a shower curtain to the side wall of a shower enclosure. Though less complicated Stemke was still a mechanical device in the form of a plurality of magnetic elements, adapted to be mounted in a spaced relation on the loose end of a shower curtain, and on the adjacent bathing area defining the side wall, to maintain the end of this curtain in closing relation with the wall to prevent any water splashing outside the bath area. The solution again, (a mechanical device), never solved the inherent problems of billowing, shifting sideways liner movement and clinging when the shower curtain is affected by forces on the inside of a shower.

Patent NL 8400-060-A, a Shower System with Magnetic Elements Along the Bottom of a Shower Curtain is a very simple mechanical device that utilizes pairs of magnetic elements to hold the bottom of a shower curtain which prevents any water from exiting the enclosure and prevents the shower curtain from clinging to the skin of the person showering. Although much simpler, it's still a mechanical device which never solved the problems of billowing along the lower portions of a limp shower curtain when water flowing out of the shower head generates forces on the inside of the shower enclosure. Thin, limp and flimsy shower curtains always exhibit the inherently negative properties of billowing, shifting side to side motion, and clinging, when lower portions of such liners are affected by forces on the inside of a shower enclosure. It is noteworthy to point out, that each of these devices pose a swallowing or choking hazard to children, who; because of their innate curiosity, will invariably separate simple mechanical devices. Unfortunately, small complex parts are easy to lose and hard to find.

These three references discussed above, cover a mechanical, magnetic or adhesive means that prevents the lower portions of a shower curtain or liner, from being pulled away from the bottom of the tub or shower walls. But, the solution in each of these references was some sort of secondary device which was used in conjunction with a shower curtain to retain it or prevent it, from billowing away from the shower wall; a problem that each inventor cited as the negative characteristic his device had solved. But none of these inventors ever solved the problems inherent with limp, flimsy plastic film liners. Their partial solutions resolved problems with complex hardware, however, they were incomplete solutions to the problems of limp and flimsy shower curtains, billowing and moving sideways at the bottom of the shower when in use. The problems that result along the lower portions of limp plastic films placed in a shower enclosure, i.e. billowing, side to side motion and clinging are negative characteristics inherent in thin flimsy films, that are not solved by the inventions. These inventions are only fastening devices, which "treat the symptoms, but do not cure The disease." The use of these fasteners, while they do deal with liners, does not solve the problems. The need remains for a solution to the inherently negative problems which result, when a limp plastic film is placed in a shower enclosure, i.e.. billowing, shifting sideways movement and clinging of the liner to the skin.

U.S. Pat. No. 4,671,026 a Bathtub Wall Surround Kit and Seal, (Wissinger), essentially creates a new set of walls in place of the existing shower walls which are usually replaced due to deterioration. The Bathtub Wall Surround Kit and Seal is a rigid physical structure that is not removably attached. The benefit of not having to grout and caulk the tiled walls frequently is what this invention really offers. The wall surround kit and seal has all of the same problems that tiled shower walls do, they have to be cleaned.

U.S. Pat. No. 2,809,379 a Portable Shower Stall is a circumferential shower curtain, that again, is only an elastic film which has all the associated problems of billowing and sideways movement, which result when air currents created by flowing water cause a partial vacuum in the shower enclosure. It does not allow the full use of the tub/shower area, and it also necessitates an ugly mechanical frame which is mounted above the user's head. It requires tubular rings which enable the top of this shower curtain to encircle the bathtub, which in effect, creates a shower enclosure. It does not line the shower walls—it is the shower walls! It normally surrounds old style, free standing tubs used for bathing, not for showering. The invention allows a conventional tub to be used as a shower, but, because a thin film now encircles the showerer, billowing, sideways movement and clinging of the flimsy liner to the skin, is even worse than when a conventional shower curtain is used. In a worst case, the film partially wraps around a person showering. The need for a solution to these problems is exacerbated by this invention, not solved.

U.S. Pat. No. 3,938,200 a Contamination Prevention Systems for Bathtubs (Roberts), is a flimsy elastic sheet. It's a biological barrier that cannot be contaminated prior to use by contact; it has a closed bottom, the bottom has to be punctured to drain the tub, and it has to be replaced after every use. Once the Roberts invention is wet, it is very slippery and too dangerous to be used for anything other than tub sit-down bathing, (because of the hazard of slipping and falling). This is the major flaw with Robert's invention. Because it has a closed bottom, it has exclusively a tub use. Once wet, this thin flimsy film is Just too dangerous to stand on. Roberts' closed bottom tub liner has to be punctured for drainage each time the patient is finished bathing. If Robert's liner had a hole in it for drainage prior to bathing or had an open bottom the film would float up to the surface of the water in the tub and be rendered useless as a contamination prevention system.

It is to be emphasized that the limp and flimsy film material used in Robert's bathtub liner does not even loosely conform to, never mind permanently retain, the contours of the shower walls; (where the sill of the tub or floor of a shower stall, meets the bottom of the shower walls). The only reason Roberts' flimsy plastic sheet is even in contact with the sides of the tub, is because water in the tub is pushing the film against the sides of the tub. The only portion of Roberts' bathtub liner that can conform to the contours of a tub, is that portion of his liner in a tub that is filled with water. It's important to remember that the portions of Roberts' tub liner that are above the sill of the tub do not even loosely conform to the contours of a tub, where the sill of the tub meets the bottom of the shower walls. It is the outward force of the water in the tub, that is pushing Robert's liner against the sides of the tub. Without the weight of water in a tub holding his liner in place, his liner springs upward and exhibits elastic recovery. Even if Roberts' tub liner had the open bottom: (which is contrary to his teachings), the sides of such a liner cannot be held securely against the tub or shower walls, by the force of water alone. It is also very important to remember that if Roberts' liner has the open bottom, it is not a biological barrier, and cannot be used as a contamination prevention system. His concept fails if a hole is made at the bottom of his liner, because rising water in the tub will cause his liner to float up to the surface. This also renders the liner useless as a contamination prevention system. And, if the closed bottom concept is used and the film is slit along the center of the bottom of the type of liner, both long slit edges of film float up to the surface as well.

An even worse-case scenario for the open bottom Roberts liner would be using it to cover the walls above a tub or the walls of a shower stall. If Roberts' closed bottom concept was placed in a shower, the sides of this closed bottom liner could not be held against the walls of the shower by the outward force of water. No amount of water; (no matter how deep), will ever stop the lower portions of his thin, flimsy tub liner from billowing, clinging or moving sideways, because instead of floating up to the surface vertically: (which happens when it is used in the tub and you make a hole in it), the Roberts liner merely moves back and forth, away from the shower walls in direct relation to the water moving around in a tub. Roberts' closed bottom bathtub liner concept was never designed to and is incapable of covering the walls above the tub, because it is just too dangerous to stand on once it becomes wet. If Robert's tub liner is made with an open bottom and used in a shower it cannot overcome the three-dimensional forces, rotational forces and forces in the x, y and z directions which pull the liner into the person showering, because it is only a limp and flimsy film. The partial vacuum caused by water generated air currents cannot be overcome by Roberts' thin and flimsy, unrestrained bathtub liner. If the open bottom concept is attempted by slitting the center of Robert's flimsy liner, the edges float up from the bottom of the tub as the tub is filled with water. Robert's closed bottom, flimsy bathtub liner cannot be used to cover the walls of a shower for four reasons:

1st, The thin film is flimsy and limp: it cannot permanently maintain its shape or position without some means of restraint.

2nd, the liner must be replaced after each use.

3rd, the closed bottom liner has to be punctured after each use to drain waste water. If punctured prior to use it is not a biological barrier and cannot be used as a contamination prevention system, and 4th, once wet, it is too dangerous to stand on.

The need for a liner which covers the walls above a tub, or the walls of a shower stall that will not billow away from the shower walls, not move sideways when contacted, and not partially cling to the skin of the showerer when affected by forces on the inside of the shower enclosure remains unmet.

U.S. Pat. No. 4,263,347 Apparatus and Method for Masking Surfaces, (Banta), is a thin, limp plastic film, which is fastened at the very top of a wall by use of an adhesive strip that is attached to the upper edge of the flimsy sheet of plastic film material. Banta's device cannot resist, never mind overcome, three-dimensional and rotational forces because it is only a folded up and rolled sheet of limp plastic film, attached at the very top of a wall with a continuous strip of adhesive tape. The inventive feature of Banta's device is this strip of adhesive tape which is attached to the very top of this rolled plastic sheet, and used to hold the upper edge of this film against a wall. Clearly, Banta has developed claims which cover this continuous strip of adhesive tape along the top of his limp plastic sheet which is folded, but, the adhesive strip which is attached to this sheet is a critical part of his invention. Banta's device did not solve the problems which result along lower portions of a thin film, shower wall liner placed in a shower enclosure, i.e., billowing, shifting sideways motion, and clinging. Banta's reference cannot overcome the three-dimensional and rotational forces which will affect the lower portions of his wall cover, (if It were used in a shower), even though it is securely fastened at the top, because it's only a flimsy sheet of plastic film and the lower portions are not restrained, Billowing, clinging and shifting side to side motion always occurs along the lower portion of Banta's liner because his cover is only a limp and flimsy sheet of thin plastic film.

Using mechanical, magnetic or adhesive fastening means cannot solve the problems that are inherently negative characteristics of thin, flimsy plastic films. These basic problems are not solved by the user, of these fastening devices, and the need for a solution to these problems remains unsolved.

Looking at just film liner properties, thin and limp, unrestrained plastic films are inherently flimsy and rebound if deformed as soon as the force is removed. This is due to Elastic Recovery, an inherent property of thermoplastics and thermoplastic films to resists permanent deformation; and this limpness is an effect of molecular shape. Thin flimsy films exhibit elastic recovery because they have a very low modulus of elasticity. The Tool and Manufacturing Engineer's Handbook, Volume 3 c 1985, defines Modulus of Elasticity as: ". . . [T]he ratio of stress to strain" within the elastic range of a material; a measure of stiffness; the ability to resist deformation." In most typical plastics, the molecules are not aligned and resemble a pile of spaghetti. This is a good model for low density polyethylene. As a result of this scramble of molecules all being pulled in different directions, the molecules will not dead-fold. Dead-folding is very important since it enables a sharp shape to be held. Despite this lack of a dead-fold property, however, the transparency, water impermeability, and low cost of polyolefin films make them an attractive material for use in a number of applications, such as a shower wall liner.

The term dead-fold is defined as: "the property of a material to retain a sharply creased fold." It is shown by a material deformed by a force which is greater than the modulus of elasticity such that the deformation is permanent and which resists returning to its original shape; i.e., the material will not yield easily once it has been dead-folded. In a high density polyethylene, (HDPE), the molecules are more aligned and more closely resemble pencils in a roughly oriented pile. HDPE will fold a bit better, but, the fold still does not lay flat and it is not retained over time. HDPE however, is very susceptible to tearing since it is so highly oriented.

As noted, plastics are too elastic to be dead-folded, since they have too low a modulus of elasticity. But metals, on the other hand, will dead fold and are materials which can be formed into shape and then permanently retain their shape and not rebound when the force is removed. This property is inherent in metals, materials which are not extensible at low pressures, and this is because the atoms of metals resemble spheres, in contrast to the strings of plastic molecules, This may be visualized by considering how beads may easily shift position and have no tendency to hold back movement, unlike the movement of strands in a pile.

Unlike plastics, however, the atoms of metals slide past each other. This is why a metal foil, when folded, stays totally folded. Materials like metal foil or aluminum foil have very high moduli of elasticity and deform in a permanent manner when stressed beyond a critical point. Table 1-1 of the Tool and Manufacturing Engineer's Handbook makes this comparison: . . . [T]he Modulus of Elasticity of Thermoplastics is 0.17–28. In contrast the Modulus of Elasticity of Aluminum Alloys is 69–79 GPa. More simply stated from The Plastic Engineer's Handbook of the Society of the Plastics Industry, 5th edition, c 1991, ". . . IT]he Modulus of Elasticity for metals is 10 to 60 times greater than that of plastics."

The combined use of dissimilar materials can produce new materials having enhanced properties which may be used to solve problems by taking advantage of the positive properties of these newly created materials and defeating the negative characteristics that are inherent in the materials when used individually. The Encyclopedia of Materials Science and Engineering, c 1986, Section 2, Composites states: ". . . [A]mong the most significant uses of plastics in building materials are composites, combinations of materials whose properties transcend those of the individual materials acting alone.

There are many patents that cover combinations of materials which use plastic, foil and rubber, in new, inventive and unobvious uses. For example, U.S. Pat. No. 5,096,759, (Simpson); a Laminated Roofing Sheet, is a thin layer of foil material attached to conventional roofing material which serves to reflect infrared and ultraviolet radiation where ". . . [r]eflected infrared rays reduce the heat transmitted to the roofing surface by the sun". While the foil of Simpson's device is not structurally strong; as Simpson states from his Summary of Invention, on page 1, lines 4–6, ". . . [T]he aluminum may be relatively thin and very flexible, because it is not intended to serve as a strengthening element", and from his Summary of the Invention, page 1, lines 12–14, that, ". . . IT]he polyethylene film is to provide the structural integrity of this roofing sheet", and from his Description of the Preferred Embodiments, page 3, lines 12–13, it states, (regarding his use of this aluminum foil), that it is, ". . . [a]n aluminum foil sheet having a desired thickness of about 0.0007 inches", it is clear that combinations of different materials can create properties that transcend those of the individual materials acting alone.

U.S. Pat. No. 2,847,948 Composite Roofing Strip, (Truitt) is a roofing material where the foil is used to withstand deterioration and also because of its ability to resist the penetration of heat into buildings. Truitt teaches the use of foil as: ". . . [a] protective metallic sheet" where ". . . It]he exposed roofing or siding surface is essentially all metallic." In this case, even though the aluminum foil was used in a roofing application that was similar to the invention of Simpson, (where heat reflective properties of the foil are taken advantage of), it was used in an unobvious way to solve the problems of exposed films being subject to UV degradation. While shielding, not heat reflectivity is the compelling claim of Truitt, his use of similar materials in a non-obvious way did not preclude patentability of his invention.

Another interesting use of film and foil is U.S. Pat. No. 4,477,509 (Mott), Disposable Lid for Pots, Pans and Like Receptacles. This disposable lid for covering and containing food: (as it is heated in a cooking vessel), uses a foil to restrain the contents of heated food from spilling over into an oven. Mott's use of a foil with film: (as was the case with Simpson), was primarily for its heat reflective properties. In Mott, it is the film which adheres to the surface portions of the food receptacle, not the foil. The foil used in Mott has no strengthening properties at all because the lid is a plurality of layers of flexible material; an outer layer that is heat reflective foil and an inner layer which is a thin, food service film. These two thin materials are not adhesively or heat sealed to one another, as shown in claim 4 of Mott, which'states: ". . . [a]re adhered one the other by direct surface contact of at least portions thereof, without the benefit of intervening materials to produce adhesion there between", but are simultaneously drawn together from two separate compartments of a very simple device and are in superposed contacting relation. The adherence here, of the film to the food receptacle is by direct contact. Since the metal layer is not attached to the plastic layer, there is no tie between the individual layers.

Often seen in construction, separate unattached and independent layers are not strengthening in nature. Look at several sheets of plywood stretched and flexed, When you glue or nail the sheets together a much greater force is needed to flex them. The layers independently would not work in the present invention and must be mutually attached. If foil is used with a liner, as it is in the Mott reference, it will billow. The primary objective of Mott's invention, in his use of foil is to prevent the food film, during heating, from bursting and thereby having heated food contents spill into the oven. As food is heated in the Mott covering device, his foil layer serves to restrain and protect the poly film from bursting. This is stated in Mott's Summary of the Invention. page 4, lines 54–55: ". . . [i]s to provide a disposable lid capable of creating and maintaining a steam dome for the contents of a receptacle, subject to cooking, baking and heating at elevated temperatures." Although Mott's use of the foil did not produce a rigid member, his device did take advantage of the deformable properties of aluminum foil: (in contrast to Simpson and Truitt), who used foil to reflect heat and as a shield, respectively. The lack of a tie between Mott's layers of film and foil, however, make it impossible for rigidity or structural strength to be imparted to the materials. Mott's combined use of film and foil did not produce a rigid member either, because the two materials, although used together, in actual practice work independently of each other. The elastic properties of a food film permit a controlled expansion as heated contents create a steam dome. The temperatures and pressures exerted on this food service film, however, reach the point where the elastic properties of the film can no longer contain the hot expanding materials in the vessel. It is at this point that the foil works to contain the expanding steam dome by preventing it from rupturing or exploding and spilling the hot food contents into the oven. In actual practice, Mott's film and foil layers work separately and separate unattached layers are not strengthing in nature. The mere use of an attached or encapsulated combination of materials: as shown in Mott's reference, does not impart rigidity or structural strength. Multiple layers of a limp material remain basically limp and are not rigidified through mere encapsulation. Foil itself is not rigid in an unbent form. Mere encapsulation with other materials will not impart rigidity or structural strength. A flat, one-dimensional unconnected foil member is not rigid or structurally strong.

U.S. Pat. No. 3,628,721 a recloseable package member, (Palmer), is a tubular or circular, food storage container which is repeatedly opened and closed by bending a thin and narrow strip of aluminum foil across its width. Palmer's deformable package is intentionally designed to be easily and repeatedly opened and closed: i.e., it will yield easily. This is because there are no forces affecting the inside of Palmer's container and that is why Palmer only uses a thin and narrow strip of aluminum foil and only radially creases it. Palmer uses just enough aluminum foil to hold a radiused crease, and this flimsy, one-dimensional creased member cannot overcome the forces on the inside of a shower enclosure.

Palmer's recloseable package member only takes advantage of the deformable properties of a thin, narrow strip of transversely creased aluminum foil, and thus, only confers a minimal property in the widthwise direction.

The thin and narrow strip of aluminum foil, used by Palmer, can only keep his bent tubular container from becoming undone, but, only as long as no force acts on it. Palmer's deformable package cannot be made rigid or structurally strong for the following reasons:

1. Palmer anticipates only an external unfolding force, and is ineffective in resisting the forces which act on the inner surface. As soon as even a small force is applied to Palmer's package member, (as opposed to the seal area), it yields.

2. Palmer's deformable strip is longitudinally oriented and repeatedly deformed. It is not a rigid member.

3. Palmer is only a one-dimensional, deformable element, It is not a three-dimensional structure:

4. The Palmer deformable package is weakened by repeated bending and unbending, thus no structural strength is ever imparted or achieved in the Palmer package; and 5. Palmer's thin and narrow, repeatedly creased aluminum foil member is bent in the wrong direction for rigidity. If forces existed on the inside of Palmer's deformable package, they could not be overcome.

Because Palmer requires the deformable member to be easily and repeatedly opened and closed, resistance to a rotational force is a property that Palmer absolutely does not want. And that is why his thin aluminum strip; as he states from pg. 4, lines 64–65, ". . . [n]eed only be wide enough to allow facile folding longitudinally".

Palmer teaches a thin and narrow strip of foil used on a sheet of film that is repeatedly bent back and forth to open or close a food storage container. Palmer calls this repeatedly deformed, aluminum foil strip, a "structure". But, the true use of the term is more commonly associated with rigidity and strength. A Truss, a Spar, or an I-Beam, for example, are said to be structures. Palmer's repeatedly deformed, radially creased member is clearly not a structure in mechanical terms.

From Kent's Mechanical Engineering Handbook, 12th Edition, c. 1950, "Structure" is defined as ". . . [a] combination of resistant bodies capable of transmitting forces or carrying loads, but having no relative motion between parts."

Palmer's recloseable package member is a limp sheet of plastic film with a very thin and narrow strip of aluminum foil, repeatedly transversly creased into a circular food storage container. Palmer's device is not a combination of resistant bodies capable of transmitting forces or carrying loads. Palmer uses only enough aluminum foil, (in thickness and in width), to hold the radiused crease which keeps his package from unfolding. It is important to note, that Palmer's mere holding of a radiused crease did not impart strength. "Strength", is defined as: ". . . [T]he power to resist force, strain or stress without yielding or breaking." This, however, is contrary to Palmer, who requires his aluminum foil strip to be easily and repeatedly opened and closed. Palmer's radially creased, aluminum foil member is merely a weak, one-dimensional deformable element, which by design and intention, yields very easily. It is not structurally strong. In fact, by definition, Palmer's device is not even a "Structure", because it is not a combination of resistant bodies capable of transmitting forces or carrying loads. In simple mechanical terms, Palmer's thin and narrow, repeatedly deformed aluminum foil member is not a physical structure.

it is important to remember that after contents of Palmer's package are removed and the package reclosed the location of his radially creased member changes, but most importantly, repeated bending and unbending of a thin and narrow strip of aluminum weakens the material.

There are materials that do crease, but are so soft: (gold leaf, for example), that they cannot become rigid or structurally strong. Palmer's use of the term: "Structure" is inaccurate, because he prefaces this term with the word deformable: which when associated with the term structure, does not connotate structural strength. A structure is a combination of resistant bodies capable of transmitting forces or carrying loads, but having no relative motion between parts. "Strength" is defined as the quality of bodies by which they sustain the application of force without breaking or yielding. Palmers use of the term: "structure", refers only to his combination of two materials.

Because Palmer's repeatedly deformed member is not a physical structure: as the term is generally used, it cannot resist forces. In reality, Palmer's recloseable package member is the exact opposite of a structure since it is designed and expected to yield very easily. If forces existed, on the inside of Palmer's recloseable package, they could not be overcome by this weak, one-dimensional member. It is clear, from Palmer's deform-able, recloseable package, that merely creasing a thin and narrow strip of aluminum foil across its width, does not create a member that is rigid, and cannot produce a member that is structurally strong.

While it is clear that many products which use plastic film and foil together have been used in new and distinctly/clearly unthought of ways to attack problems that no one had previously solved, it is also clear that the specific characteristics of the materials used along with their method of application, create definite limits in the capabilities of these combinations. The use of similar materials for other non-obvious uses; or in different applications, does not eliminate patentability. One combination of materials alone is not a solution to all problems, as shown by Palmer's limited use, repeatedly deformed, transversely creased aluminum foil strip.

Looking at this prior art in light of a liner, the lower portions of an unrigidified or unrestrained, thin film shower wall liner always exhibit the following negative characteristics which have not been solved by the prior art. When affected by forces on the inside of a shower enclosure the lower portions such liners do the following negative things:

1. They billow away from the shower walls,
2. They move from side to side,
3. and they cling to the skin of the person showering.

There remains a need for a shower wall liner made from a thin plastic film whose lower portions, when affected by the forces on the inside of the shower enclosure, will:

1. Not billow away from the shower walls,
2. Not move from side to side,
3. Not let water under the liner, and
4. Be restrained from clinging to the skin.

These needs are presently unmet.

DESCRIPTION OF THE INVENTION

The present invention has solved the problems that result at the lower portions of a thin film, shower wall liner, i.e. billowing, moving sideways and clinging to the skin of the showerer, by creating a structurally rigid contained framework that uses two different materials in a new and non-obvious manner for a specific application not previously taught.

The invention was developed as the solution to the problems resulting when a long and tall, limp sheet of unrestrained plastic film is placed in a shower. As water flows out of the shower head, water generated air currents create a partial vacuum in a shower which make the lower portions of a flimsy, unrestrained film liner, billow away from the shower walls, move sideways when contacted and cling to the skin of the person showering.

A solution to the problems is important because until solved, widespread consumer acceptance of a lined shower wall with a thin plastic film is unlikely.

This invention is a plastic film to,be used as a liner for covering shower walls that has at its bottom a metal foil material of a predetermined thickness and width, that is first latitudinally dead-folded a single time to produce an "L-shaped" bottom reinforcing member, which is rigid, and then second, corner-folded to form one or more three-dimensional corner members, which are structurally strong, and which, when used together, form a structurally rigid contained framework along the lower portions of the liner which enable it to overcome the three-dimensional forces, rotational forces, and forces in the x, y and z directions, which exist on the inside of a shower enclosure and continuously affect the liner.

From the New Webster Encyclopedia Dictionary of the English Language, 1980 Edition, the term: "Rigidity" is defined as: "[sitillness, not pliant, not easily bent: in physics, theoretically such as to resist change of form when acted upon by any force," From this same source, the term, "Strength" is defined as: ". . . [t]he quality of bodies by which they sustain the application of forces without breaking or yielding." As previously noted, from Kent's Mechanical Engineering Handbook, 12th Ed., c 1950, "Structure" is defined as: ". . . [a] combination of resistant bodies capable of transmitting forces or carrying loads, but having no relative motion between parts." In this invention, the collectively formed and used, structurally rigid contained framework is a combination of resistant bodies,.i.e., (the rigid, L-shaped bottom reinforcing member and the three-dimensional corner members), which are capable of carrying loads; i.e., (overcoming three-dimensional forces, rotational forces and forces in the x, y and z directions) and will sustain the application of force{s} without yielding or breaking i.e., (will not billow away from the shower walls, move sideways when contacted, or partially cling to the skin of the person showering).

It's important to recognize that this invention has three separate and distinct aspects, first, the "L-shaped"

reinforcing member, which imparts rigidity to the lower portions of the shower wall liner, second, the three-dimensional corner members, which are structurally strong and formed from the rigid, "L-shaped" bottom reinforcing member, and third, the structurally rigid contained framework that is created when these two physical structures are used together. It is important to understand that rigidity in the "L-shaped" bottom reinforcing member and structural strength in the three-dimensional corner members, are two distinctly different properties which must work collectively and simultaneously in this invention to impart structural rigidity to the contained framework. It is not one property or the other, but both properties which are required to collectively fabricate a contained framework that is structurally rigid.

This invention affords a shower wall liner that not only overcomes the forces on the inside of a shower enclosure, but also avoids the need for cleaning, maintenance and repairs which are done to walls above a tub or the walls of a shower stall. The liner is a consumer convenience which is easily set up by one person, it is designed to be replaced about every 2 to 3 months as it becomes soiled with dirt and soap scum and it is also an environmentally safe product since toxic chemicals present in bathroom cleaners are not used. In the environmentally conscious climate of the 1990's, with extrusion processes developed that cost-effectively re-use post-consumer polyolefins, this is a product which can enjoy widespread consumer acceptance, especially if made with recyclables. Accessory items like a mirror, soap dish shield or decorations may also be attached to this liner and the liner can be produced in a variety of colors.

The shower wall liner is removably attached to the upper walls of a shower with a fastening means. The liner is folded and rolled for packaging so that it will easily unroll and unfold onto the shower walls. Once it is unfolded and covers the shower walls it is fitted and aligned as needed and the foil material is first, latitudinally dead-folded to produce an "L-shaped" reinforcing member that is rigid and then second, further folded into structurally strong, three-dimensional corner members, which, when used collectively, form a structurally rigid contained framework along the bottom of this liner to overcome the forces which exist on the inside of the shower enclosure.

The metal foil material that is used to form the structurally rigid contained framework of this liner is mutually and directly attached to a thin, water-impermeable, 3 mil plastic film. The metal foil used must be thick enough, wide enough and long enough to produce an "L-shaped" bottom reinforcing member which is rigid when it is latitudinally or axially dead-folded.

A foil which is too thin cannot be formed into a rigid member, such as the gold leaf previously mentioned in the Background Section. Another example would be the sputtered coatings placed on bags used to package electronic components. These bags are sputtered with a very thin layer of metallic material, (typically an aluminum) which makes the surface of the bag conductive and dissipative of static, but, it does not change the properties of the film or their sealing properties, to say nothing of the mechanical properties of the film.

In contrast, a foil which is too thick, is too difficult to form into a three-dimensional, corner member by hand. An example of this would be the flashing materials used in the roofing trade which are not easily folded by hand and would take tools like a bending brake to physically form it. And, while the material would be rigid, it would not fit within the confines of an invention used in a shower.

These same conditions apply to the width of the metal foil material. A foil that is too narrow, say one quarter inch wide, will not produce an "L-shaped" member which is rigid and reinforcing, and it cannot produce a structurally strong, three-dimensional corner member. In contrast, a foil which is too wide, is too difficult to corner-fold by hand and extends beyond the sill of a tub In this invention, if the foil material used is too thin, too narrow or too thin and narrow, it can't be collectively formed into a structurally rigid contained framework that is capable of overcoming the forces which exist on the inside of the shower when it is operating. The reverse is the case if the foil used is too thick, too wide or too thick and wide. The foil typically used in the present invention is between 1 mil and 4 mils in thickness, between 1.5 and 4 inches in width, and is attached to a polyolefin film which is at least $\frac{3}{4}$ mil thick and will typically not exceed 6 mils. Forming the structurally rigid contained framework requires using a foil which is thick enough, wide enough and long enough, to be first, latitudinally or axially dead-folded into an "L-shaped" bottom reinforcing member which is rigid, and then second, further folded into three-dimensional corner members which are structurally strong.

The flattened out wire of the Palmer device for example, cannot be formed into a rigid member. It is not possible to create a rigid member from Palmer's aluminum strip because Palmer intentionally uses a foil which is too thin, too narrow and repeatedly creased in the wrong direction for rigidity. As previously noted, Palmer's repeatedly deformed, radially creased, recloseable package member cannot be made rigid or structurally strong, because it is merely a thin and narrow strip of radially creased aluminum foil. Structural rigidity is absolutely necessary. (at the bottom of the shower wall liner), if the liner is to overcome forces that exist on the inside of the shower enclosure; and to achieve this structural rigidity, (in a limp and flimsy plastic film), it is essential to use a metal foil which is thick enough, wide enough and long enough. As previously noted, rigidity and structural strength are two separate and distinct physical properties that are collectively used to form a structurally rigid contained framework that enables this liner to overcome the forces on the inside of a shower. Structural rigidity, (essential in this invention), is never achieved or even possible with Palmer's thin and narrow, repeatedly creased strip of aluminum foil.

To form an "L-shaped" bottom reinforcing member that is rigid, the foil used must be wide enough as well as thick enough and long enough. For example, a $\frac{1}{4}$ inch wide, (2 mil thick strip), is too narrow. Latitudinally dead-folding it into legs which are about 1/16 inch wide simply will not produce a member which is rigid. In a right triangle the 2 sides that form the right angle are called "Legs", the L-shaped member resembles two of the sides of a right triangle. If you increase the width of the metal foil to 1 inch, and produce legs of about $\frac{1}{2}$ inch wide, some rigidity is imparted, but it is insufficient in overcoming forces that exist on the inside of the shower enclosure. When the legs of the "L-shaped" reinforcing member each reach a width of 1 inch, significant rigidity is achieved. In contrast, an "L-shaped" member which is 6 inches wide is not easily latitudinally dead-folded. It extends beyond the sill of the tub and is too difficult to corner-fold by hand.

The thickness of the foil used is just as important as the width. If the foil material used is 2 inches wide but only ½ mil thick it cannot form a rigidifying member sufficient to overcome the rotational forces on the inside of the shower enclosure. When you reach foil thicknesses which exceed 4 mils. however, the foil also becomes too difficult to corner-fold without tools. As previously noted, however, using a foil material that is wide enough is only part of the solution in this invention. To form a structurally rigid contained framework capable of overcoming the three-dimensional forces and rotational forces, (that exist on the inside of a shower enclosure), you have to use a metal foil material which is thick enough, wide enough and long enough. When the foil which is attached to this 3 mil polyolefin sheet is 2 inches wide, 2 mils thick and is first, latitudinally or axially dead-folded, second, corner-folded, and then third, used collectively, significant structural rigidity is imparted to the lower portions of this liner.

In addition, there are economic restraints which restrict the use of material thicknesses considerably. Take for example, a foil of five mils thick. It is much more expensive than the two mil foil, which is the preferred embodiment of this invention. Likewise, the cost of a film is essentially in proportion to its thickness. The three mil film is optimal. Going up to a five or six mil film proportionally increases the cost, but offers no additional benefits. Thus, there are economic optimization factors that need to be considered when selecting widths and thicknesses of foil and film. All these form a matrix and the solution to this matrix produces a relatively narrow set of feasible production entities which are likely to be salable in the real world market.

The solution to the problems of billowing, sideways motion and clinging of the lower portion of the shower wall liner, entailed the development of a limp, plastic film liner that would overcome three-dimensional forces and rotational forces on the inside of the shower enclosure, but, be able do so without the use of a mechanical, magnetic or adhesive fastening means, thus, requiring a liner which is primarily flexible and elastic, but structurally rigid along the bottom where billowing, shifting sideways motion and clinging occurs. The solution to these problems is a liner which uses structural rigidity in a contained frame to overcome these forces.

The specific aspects of the present invention, are discussed in the following Sections:

I) The "L-shaped" bottom reinforcing member, which is rigid,

II) The three-dimensional corner members, which are structurally strong, and,

III) The contained framework that is structurally rigid are discussed separately below the effects are clearly additive.

The Materials Used are discussed in Section IV, and the Use and Attachment of the Shower Wall Liner is discussed in Section V.

SECTION I—RIGID, "L-SHAPED" REINFORCING MEMBER

When foil is attached to a limp, flimsy plastic film and used structurally, it has a potential to solve the problems associated with limp film, shower curtains billowing away from the shower walls and moving sideways if it is formed into an "L-shaped" member that is rigid. But, as previously stated, merely dead-folding this "L-shaped" member is only a part of the solution. The foil used to create this "L-shaped" bottom reinforcing member must be thick enough, wide enough and long enough and be dead folded along its lengthwise or latitudinal axis, so that each leg of this member does impart rigidity to the lower portions of the liner.

The reason a flimsy plastic liner billows and moves sideways when used in the shower is related to the materials' low Modulus of Elasticity which makes it unsuitable for structural purposes such as retaining a rigid shape. Limp and flimsy plastic films, without the metal foil or dead fold capabilities, do not possess the stiffness to form rigid members and this is the critical issue addressed in the present invention.

The Encyclopedia of Materials Science and Engineering, copyright 1986, Section 1.3, Structural and Semi-Structural Uses, explains this where it states: ". . . [P]lain unmodified plastics are moderate in strength but generally too low in stiffness, having low moduli of elasticity to be useful in structural or semi-structural applications."

Bending a thin and narrow strip of aluminum foil across its widthwise axis into a one-dimensional member, (as shown in Palmer's deformable strip), does not create a rigid member. This invention will not work if a thin and narrow strip of foil is used, or if the material is repeatedly bent back and forth. This invention requires structural rigidity and structural rigidity necessitates the collective use of rigidity and structural strength two different properties that must work collectively and simultaneously in the invention. It is not one property or the other, but both, which are required for the lower portions of this liner to overcome the three dimensional forces, rotational forces, and forces in the x, y and z directions which exist on the inside of a shower.

It is important to remember that the "L-shaped" structure is behind only the I-Beam, and Rectangular Channel in strength to weight ratios for resisting sideways motion. The use of a limp film with a structurally rigid framework that is used to overcome partial vacuum, water generated air currents continously affecting lower portions of this liner, is a new concept in liners which has exploited the positive properties of a low modulus polyolefin film, where they are needed; and defeated the negative properties of a low modulus elastic polyolefin film, where they are unwanted.

In Palmer's device, for example, his creasing of a thin, narrow strip, (across its width), never produced rigidity: it retarded unfolding only and this retardance can be countering a force which is much less than that required for structural rigidity. The deformable properties of Palmer's thin and narrow, transversely creased aluminum foil strip, worked fine in his application. These properties, however, are unwanted and useless in a shower wall liner application. Palmer's transversely creased and repeatedly creased, deformable package member was not designed to and is not capable of contending with the pulling, twisting and shifting forces which are on the inside of the shower enclosure and continuously affect the lower portions of this liner. In fact, once Palmer's strip is deformed, no forces act on his radially creased member until it is reopened. This is obvious since only an unfolding force is acting on Palmer's bent strip and the force is on the outside of his package; in contrast to the three-dimensional forces, and rotational forces which exist on the inside of a shower enclosure.

Rigidity, structural strength, and structural rigidity, are properties that cannot be achieved without the lengthwise dead-folding of a permanently deformable material. As previously noted, in the prior discussion of rigidity and structure we know that in this invention rigidity is achieved when the metal foil, (of sufficient thickness and width) is latitudinally dead-folded into the "L-shaped" reinforcing member. Structural strength is achieved as the "L-shaped" bottom reinforcing member is corner-folded, and structural rigidity is achieved when the two physical structures are used collectively.

The reason why rigidity and structural strength are not present in Palmer's transversely creased package member is easily visualized by holding a sheet of paper by one of its short sides and watching how it droops and is unable to carry even its own weight. Another way of visualizing Palmer's deformable strip can be achieved by trying to span a distance of about 8 inches, between two upright books, with a thin sheet of paper. The sheet of paper laid over these two books is so flexible that it sags down and slides off the tops of the books. If you form this paper into a dome and place both edges against the hard covers of a book, the dome shape is maintained, but it is delicate. If you then place a thin and narrow strip of foil along an edge of this paper and then bend it to a radiused point, (as Palmer has it), one edge may stay, but not well, and the other sags down. This is a good example of Palmer's repeatedly deformed member, and his flimsy, one-dimensional member cannot overcome the three-dimensional forces and rotational forces which exist on the inside of a shower when it is operating.

If you latitudinally dead-fold a thick enough, wide enough and long enough metal foil, (as described), significant rigidity is achieved along the entire length of the member. This rigidifying effect also extends far beyond the metal foil itself, and stiffens some of the plastic film the foil is attached to. When this rigid, "L-shaped" member is placed across the books, (from the first example), the member stays in place and does not slide down between the two books. The ultimate example of the rigidifying effect of an L-shape is seen when the shape is repeatedly folded or accordion folded, into the physical structure known as the "Folded Plate", which is typically used in bridge construction.

Palmer's device, a foil strip on a film for a package, that is transversely creased and repeatedly deformed, could not even resist, never mind overcome, the three-dimensional forces, rotational forces, and forces in the x, y and z directions, which result in billowing, shifting sideways liner movement and partial clinging of the film to the skin of the showerer, for these reasons:

1st, the package foil strip is simply too thin and narrow to form a rigid member. Palmer uses aluminum foil for its deformable properties, and states that his aluminum foil: ". . . [n]eed only be wide enough to allow facile folding longitudinally." Although a wire may be folded longitudinally, it cannot be folded along its opposite axis to produce a corner member. Also note that Palmer, from his first claim, requires only enough foil material to ". . . [m]aintain a creased configuration."

2nd, Only an external unfolding force acts on the package. Palmer's one-dimensional, deformable strip is completely ineffective in resisting forces which act on the inner surface, such as those forces on the inside of a shower continuously affecting the shower wall liner In fact, as soon as even a small force is applied to the deformable strip of Palmer, as opposed to the seal area, it yields easily and the container collapses.

3rd, Only a narrow amount of his aluminum strip is actually creased, and it is creased across the width of the strip, i.e., in the wrong direction for rigidity. Longitudinally bending a thin, narrow strip of aluminum foil, (across its width), does not create a rigid member which is capable of overcoming the forces which exist on the inside of a shower. Palmer's thin and narrow, radially creased strip only yields deformable properties.

4th, Only a one-dimensional member is made by Palmer's method of foil bending. Thin, one-dimensional aluminum foil members are not normally rigid. Viewing Palmer's flattened out wire; used in the longitudinal axis (as a structural member), is an inaccurate depiction. To form the structurally rigid contained framework at the bottom of this liner you must use a metal foil which is thick enough, wide enough and long enough so that when it is latitudinally dead-folded and then corner-folded it becomes rigid and structurally strong. The two members must then be used collectively to overcome the forces in the shower. The Palmer foil member cannot do this and does not anticipate it.

5th, As Palmer's strip is bent back and forth, over and over again, any stiffness may be degraded as a result of the multiple rebending. Palmer's package member cannot be made structurally rigid because using it requires making a new crease in the foil material every time the package is opened and closed. The structurally rigid contained framework of this invention must permanently retain certain exact contours of the shower walls and the location of these physical structures cannot be changed. Repeated bending and unbending of an aluminum strip, (which Palmer teaches to open and close his food storage container) cannot be tolerated by this invention which is weakened if folded more than once, and rendered useless if repeatedly folded and unfolded. Palmer's repeatedly deformed, transversely creased, aluminum foil member, cannot do these things. It:

1. Cannot produce an L-shaped member which is rigid,

2. Cannot produce three-dimensional corner members which are structurally strong, and it, 3. Cannot produce a structurally rigid contained framework capable of overcoming the forces exerted against the shower wall liner on the inside of the enclosure.

The reason why the rigid, "L-shaped" bottom reinforcing member will overcome the forces on the inside of a shower enclosure, that cause billowing and shifting sideways liner motion, can be understood by visualizing a sheet of paper, which instead of being curved upwards, is now dead-folded along its latitudinal axis. We know that when this is done substantial rigidity is achieved. Unlike the example of a flat sheet of paper spanning two books and slipping down between them, the paper now dead folded lengthwise, forms a member that is rigid and when folded into a group of L-shapes, forms the folded plate discussed above.

This invention solves the problems of the thin shower curtain or the tub enclosure liner, allowing the objectionable billowing, shifting side to side movement and, the clinging or contact of the liner with the skin, by employing a contained framework which is composed of three separate and distinct aspects.

While the first aspect of this invention is the forming of a rigid "L-shaped" bottom reinforcing member, (which is produced when a thick enough, wide enough and long enough metal foil material is latitudinally dead-folded), this bottom reinforcing member also provides a cure for shifting sideways liner movement and for entry of water under the bottom of the liner. This has solved previous problems which prevented the acceptance of wall liners in showers, by eliminating problems which remain even after the application of the teachings in the prior art. But, merely forming the rigid, "L-shaped" bottom reinforcing member is only part of the invention because this invention has three separate and distinct aspects.

SECTION II—MULTI-DIMENSIONAL CORNER MEMBERS

The second aspect of this invention entails the formation of the three-dimensional, structurally strong corner members that are made from portions of the rigid. "L-shaped" bottom reinforcing member when this member is further folded into the corners of the shower walls, or along the floor of the shower stall.

At least three corner-folding techniques may be used to form the structurally strong, three-dimensional corner members. Superior corner-folding methods yield superior three-dimensional structures. The basic method is the "Scrunch Fold Method", an enhanced version is the "Mitered Cut Method" and the best method is the "Mitered Fold Method". As the "L-shaped" member is formed along the sill of the tub and in corners of the shower walls, or along the floor of a shower stall and in the corners of the shower walls, it becomes rigid, That portion of the "L-shaped" member that lies horizontally on the sill of the tub or floor of the shower stall, is known as the Drip Edge. In a shower enclosure, three walls normally form the enclosed area above a tub or above the floor of the shower stall, thereby creating three drip edges that converge and project upwards and outwards in the corners of the shower walls. These three drip edges are always created when the "L-shaped" bottom reinforcing member is formed, 2 end wall drip edges and 1 side wall drip edge.

The Scrunch Fold Method is a simple method that uses fingertip pressure to squash and crush the upwardly and outwardly projecting drip edge portions of the rigid "L-shaped" bottom reinforcing member converging in the corners of the shower walls. The word "scrunch" is used to define the process of squashing and crunching this "L-shaped" bottom reinforcing member into a basically strong, three-dimensional corner member. (Not shown)

The Mitered Cut Method, is an intermediate method, shown in FIG. 2, that forms a three-dimensional corner member which is much stronger than that made by the scrunch fold. In this method, the upwardly and outwardly projecting drip edge portion of the L-shaped member is cut at a 45 degree angle, relative to the corners of the shower walls, so that one of the two cut drip edges is rotated horizontally to overlap the other. The ends of the cut drip edges now butt up against the rigid shower walls and tend to be mutually reinforcing. This method produces a much stronger corner member when it is compared to the member made by using the scrunch fold.

The "Mitered Fold Method", is the best method and produces a corner member that is far superior to the two previous methods. In this method, the converging upwardly and outwardly projecting, end wall drip edge portion of the "L-shaped" member is rotated 90 degrees horizontally to end up underneath the side wall drip edge. The overlapping side wall drip edge is then dead-folded, and a very strong corner member is made. This method is reversible. The side wall drip edge can be rotated 90 degrees and end up underneath the end wall drip edge.

With the corner members, as described, the two elements can now be combined into a useful structure, as noted below.

SECTION III—THE COMBINED PROPERTIES

These three folding techniques produce a self-reinforcing structural fold which cannot be created in a single polyolefin film. Rigidity, in the x - y planes, provided by the "L-shaped" bottom reinforcing member, is used with structural strength, in the z plane, formed by three-dimensional corner members, to collectively create a structurally rigid contained framework which is effective in overcoming the forces on the inside of a shower.

The structurally rigid contained framework, (of this invention), is a true physical structure because it is a combination of resistant bodies capable of sustaining the application of forces without yielding. Collectively using a rigid, "L-shaped" bottom reinforcing member with one or more three-dimensional corner members is a new concept that has solved the problems of billowing, shifting side to side liner motion and clinging to skin, by attacking the source of these problems, i.e., the inherently flimsy nature of thin plastic film. By doing this, it has also created a liner with a member that can be supplementally sealed against the incursion of water and moisture under and behind the liner.

This invention teaches a collective use of three distinctly different aspects to impart structural rigidity to the bottom of the liner so that lower portions of this liner overcome forces on the inside of the shower.

The three distinctly different physical structures which are the critical aspects of this invention are:

1. The "L-shaped" bottom reinforcing member which is rigid,
2. The three-dimensional corner members that are structurally strong, and,
3. The contained framework which is structurally rigid and produced when these two physical structures are used collectively.

In this invention, unlike the Palmer reference, the use of the terms: "structural rigidity" and "structurally strong", are true usages of these terms because the invention specifically teaches the collective use of rigidity and strength to achieve structural rigidity.

The "structural rigidity", (as we use the term) that is created in this invention, is the result of permanent deformation by one-time, latitudinal dead-folding and corner-folding techniques, whereby a permanently deformable conforming metal foil material, (attached to an otherwise ordinary and flimsy sheet of plastic film), is made structurally rigid to overcome the forces which are exerted against this liner on the inside of the shower.

An unrigidified flimsy film cannot even resist, never mind overcome these forces. Referring back to the previous discussion of rigidity and structure, as it applies in the present invention, "rigidity" is defined as ". . . [s]tiffness, not pliant, not easily bent, in physics theoretically such as to resist change of form when acted upon by a force." The term "strength" is defined as: ". . . [t]he quality of bodies by which they sustain an application of forces without yielding or breaking." As previously stated in Kent's Mechanical Engineering Handbook, 12th Edition, c. 1950, "Structure" is defined as: ". . . [a] combination of resistant bodies capable of transmitting forces or carrying loads, but having no relative motion between parts." The structurally rigid contained frame, of this invention, is a combination of resistant bodies, i.e., (the rigid, "L-shaped" bottom reinforcing member and three-dimensional, structurally strong corner members), which are capable of carrying loads, (overcoming the three-dimensional forces, rotational forces and forces in the x, y and z directions), and sustaining the application of force{s} without yielding or breaking, i.e., (will not billow away from the shower walls, move sideways when contacted, or partially cling to the skin of the person in the shower).

A material which is deformable, and has a high modulus of elasticity, thus requiring a relatively large force to initially deform it, thereafter is permanently deformed, as exampled by the three-dimensional corner members and the rigid "L-shaped" bottom reinforcing member. Because modulus of elasticity, (here), represents the ability of the metal foil material to resist deformation, a high modulus of elasticity is indicated in an otherwise deformable material, so that once deformed the material resists further deformation; i.e., it will stay there, it will not yield, and it will not return to its original position. The higher the modulus of elasticity the greater the resistance to deformation, and the less likely it is to be deformed back to its original position if acted upon or bumped, etc.

In the shower environment, forces on the inside the enclosure continuously affect the shower wall liner and work to pull, twist and shift, lower portions of the liner away from the shower walls. These forces must be overcome and the structurally rigid contained framework overcomes these forces.

The 3 critical aspects of the invention are thus:

1. The rigid, "L-shaped" bottom reinforcing member,
2. The structurally strong three-dimensional members and
3. The collectively formed, structurally rigid contained framework which overcomes forces on the inside of the shower enclosure.

SECTION IV—THE MATERIALS USED

Along the lower portion of this liner there is a permanently deformable conforming metal foil which is latitudinally dead-folded into an "L-shaped" reinforcing member that is rigid. Portions of the "L-shaped" bottom reinforcing member are then further folded or permanently deformed into three-dimensional corner members which are structurally strong. When these physical structures are used together they transform the bottom of the liner into a structurally rigid contained framework which will permanently retain the exact contours of the corners of the shower walls along the sill of the tub, or floor of the shower stall, and overcome the forces on the inside of the shower enclosure.

It is to be noted that the formation of a contained framework that is structurally rigid requires the use of a permanently deformable conforming material that is of sufficient thickness and width to create rigid and structurally strong members at the bottom of this liner, when dead-folded and further corner folded as described. The thickness as well as the width of these folded legs, combine to produce the rigidity, and in general, certain widths do not function effectively unless the foil is so thick as to become too costly, or not easily deformable. This invention anticipates a working range of metal foil thicknesses between 1 and 4 mils, and foil widths of between 1.5 inches and 4 inches, respectively.

As previously discussed, foil thicknesses above 4 mils cannot be easily deformed, foil thicknesses below 1 mil cannot produce members that are rigid, foil widths above 4 inches are excessive, and foil widths below 1.5 inches cannot create structurally strong corner members.

The rigid, "L-shaped" bottom reinforcing member and structurally strong three-dimensional corner members retain their permanent deformation because the foil used has a high modulus of elasticity such that it resists returning to its original position once it has been permanently deformed by forces which exceed its modulus of elasticity.

The Tool and Manufacturing Engineeer's Handbook Volume 3, c 1985, defines "Modulus of Elasticity" as: ". . . [T]he ratio of stress to strain within the elastic range of a material, a measure of stiffness, the ability to resist deformation." The Plastic Engineer's Handbook of the Society of the Plastics Industry, c. 1991, 5th edition, states: ". . . [T]he Modulus of Elasticity for metals is 10 to 60 times greater than that of plastics."

Polyolefins on the other hand, have a very low modulus of elasticity and rebound if deformed as soon as the force is removed. This is due to Elastic Recovery, an inherent property of thermoplastics and thermoplastic films to resist permanent deformation; a result of the molecular shape and bonding between adjacent molecules.

From Table 1-1, of the Tool and Manufacturing Engineer's Handbook, c 1985, the Modulus of Elasticity of Thermoplastics is 0.17–28.0 GPa. In contrast, the modulus of elasticity of aluminum alloys is 69–79 GPa.

Flexible plastic films used in commerce are at the very bottom of Table 1-1. It is obvious that any relatively stiff material which can be deformed, with a modulus of 40 GPa or more, will tend to be permanently deformably conforming.

In a typical plastic the molecules are not aligned and resemble a pile of spaghetti. This is a good model for low density polyethylene. As a result of this scramble of molecules all being pulled in different directions, LDPE will not dead-fold.

In a high density polyethylene the molecules are much more aligned, and more closely resemble pencils in a roughly oriented pile. HDPE will fold a bit better but the fold still does not lay flat and is not retained over time. HDPE, however, is very subject to tear problems because it is so highly oriented. Any openings created in a HDPE shower wall liner (to access the water controls or to suspend the liner), will cause the HDPE liner to tear easily under only a light load.

In contrast to the atoms of most plastics, the atoms of metals resemble spheres. This may be visualized by considering how beads easily shift position and have no tendency to hold back the movement, as opposed to the movement of strands in a pile.

Unlike plastics, the atoms of metal slide past each other. This is why a metal foil, when dead-folded, stays totally folded. Materials like metal foil have a very high modulus of elasticity and deform in a permanent manner when stressed past a critical point. Metals hold the deformation, as opposed to materials like polyolefins that rebound after a force is removed: or glasses where there is brittleness.

The application of a flimsy plastic film with a structurally rigid contained framework is a new concept in limp and flimsy, plastic film liners that has created a liner with enhanced user properties and performance.

It is to be noted that other materials, such as paper, are somewhat dead-foldable, but are much less deformable than a metal foil or aluminum foil. These materials could be used to produce a bottom member which is better than those now available, but, they would be much less effective than metal foils like aluminum foil since their deformable properties are also much lower, actually being between that of metal and plastic.

Glass, is an example of a rigid material which would also not work—it would fracture when bent. This invention does not anticipate the folding or bending of brittle materials.

SECTION V—USE AND ATTACHMENT

When the shower wall liner is unrolled across, and unfolded along the shower walls, the permanently deformable conforming metal foil material at the bottom of the liner is latitudinally dead-folded once to create an "L-shaped" bottom reinforcing member which is rigid, and then further folded, by mitering, cutting or other means to produce one or more three-dimensional corner members that are structurally strong, where the lower walls of a shower meet the sill of a tub or the floor of a stall.

To form the structurally rigid contained framework the metal foil material, for example aluminum foil, used with a liner must be at least 1 inch wide, at least 1 mil thick, be mutually and directly attached along the bottom edge of this thin plastic film, be latitudinally dead-folded into an "L-shaped member which is rigid, be further folded into one or more three-dimensional corner members which are structurally strong, and then be used together. It is to be noted, that a 1 inch wide, 1 mil thick metal foil, which is latitudinally dead folded and then further corner folded, will only produce marginally useful structures.

However, when the foil material is doubled in thickness and width to 2 mils and 2 inches respectively, latitudinally dead-folded and corner-folded as described and the resultant physical structures used collectively, a structurally rigid contained framework is formed along the lower portions of the liner that is able to overcome the forces exerted on the inside of a shower enclosure, The bottom of this linnet is no longer merely an ordinary limp and flimsy billowing film. It is something totally different from what it was. It has new properties and characteristics now which cannot be achieved in ordinary limp and flimsy, plastic film liner concepts.

The shower wall liner is adapted for use in a number of enclosures and works especially well in shower stalls since the bottom remains open so that footing and drainage are not affected. The preferred hanging method in this invention is a mechanical device that uses pairs of magnetically attractable members, having contrasting sloping surfaces, which suspend and force the top of the shower wall liner close to the upper shower walls. The effective means by which to hang this invention is found in U.S. Pat. No. 5,003,647. There are also other methods which are discussed in the Embodiments Section.

The lower portions of the shower wall liner are structurally rigidified by means of the contained framework, which prevents billowing, shifting sideways liner motion, and contact of this liner with the skin: (problems that even thick, heavy shower curtains exhibit).

The structurally rigid contained framework may be supplementally sealed against water penetrating under and behind the liner should the person want to bathe instead of shower. This is possible because the drip edge legs of the rigid, "L-shaped" bottom reinforcing member, lie horizontally on the sill of a tub and may be sealed against water penetrating behind the liner and deteriorating the caulk at the bottom of the shower walls with a variety of effective means which are well known, and not shown.

The open bottom shower wall liner is quickly and easily affixed to the walls above a tub or the walls of a shower stall. The present invention works equally well covering the walls above a tub, or the walls of a shower stall. It works equally well in showers regardless of whether the water controls and spigot are on the left end wall or right end wall of the shower enclosure, because either side of this liner may be used. When the liner is unrolled for use, it may be unrolled from left to right and unfold forwardly and downwardly: or, it may be unrolled from right to left and unfold rearwardly and downwardly.

The shower wall liner is removably attached so that a soiled liner is quickly and easily replaced with a new clean liner: about every two to three months. A variety of fastening methods work with this invention. The primary material used in the liner is an elastic and extensible, flimsy, polyolefin film. There are logical reasons for such a use: there is a need for flexibility, and a need for elastic conformance around water controls and projecting hardware. Since polyolefins have a very low modulus of elasticity, they easily stretch to create excellent seals. Polyolefins are relatively inexpensive and are neatly rolled and folded for packaging purposes. This compact form offers the end-use consumer an easily handled, lightweight product, which when ready to be set up, is done very easily.

But, polyolefin films alone, however, because of their very low modulus of elasticity, are not suited for structural purposes such as holding a sharp corner shape since they cannot be made to form rigid or structurally strong members when in film form alone.

Although elastic film, (by itself), is an asset where flexibility is needed, at the top and around water controls, it is a detriment at the bottom of this liner where rigidity is essential and elasticity renders such a liner useless. Structural rigidity, (along the lower portions of this liner), is essential in preventing the lower portions of the liner from billowing away from the shower walls and moving sideways when contacted. In a worst case, an exclusively limp and flimsy, plastic film liner could wrap around the person taking a shower.

The Encyclopedia of Materials Science and Engineering, copyright 1986, Section 1.3, Structural and Semi-Structural Uses, explains this where it states: ". . . [P]lain unmodified plastics are moderate in strength but generally too low in stiffness, having low moduli of elasticity, to be useful in structural and semi-structural applications."

That is why this application of a thick enough, wide enough and long enough metal foil, (attached to an otherwise ordinary flimsy polyolefin film), is so effective in overcoming the forces on the inside of a shower enclosure when the foil is latitudinally dead-folded and corner-folded, (as described), to collectively produce a structurally rigid contained framework along the bottom of a thin film shower wall liner. Without the contained framework the lower portions of ordinary limp and flimsy shower wall liners, billow away from the shower walls, move from side to side, and cause the unpleasant and unwanted contact of the liner with the skin. These problems have been solved by use of the present invention.

The three-dimensional, structurally strong corner members and the rigid, "L-shaped" bottom reinforcing member, (used together), impart a structural rigidity to the lower portions of this liner that cannot be achieved in ordinary flimsy plastic film, liner concepts.

The open bottom shower wall liner exploits the positive properties of a limp polyolefin film where they are needed. It also defeats the negative properties of a flimsy polyolefin film where they are unwanted.

DESCRIPTION OF THE PREFERRED EMBODIMENT OF THE INVENTION

Figure 1A:
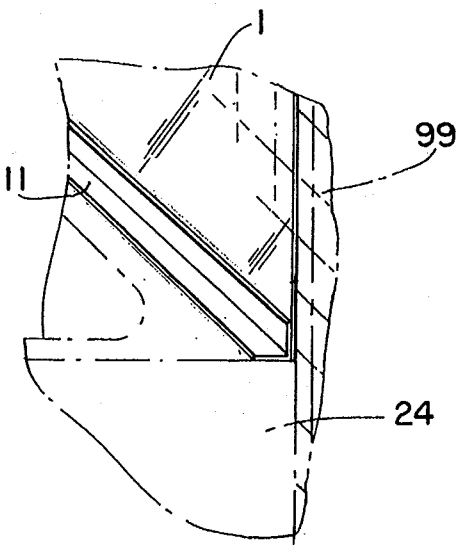
FIG. 1 is an expanded perspective view of the open bottom, shower wall liner 1: covering the shower walls 99: above a tub 24: and shows the rigid, L-shaped bottom reinforcing member 11; and the mirror 18.
Figure 1:
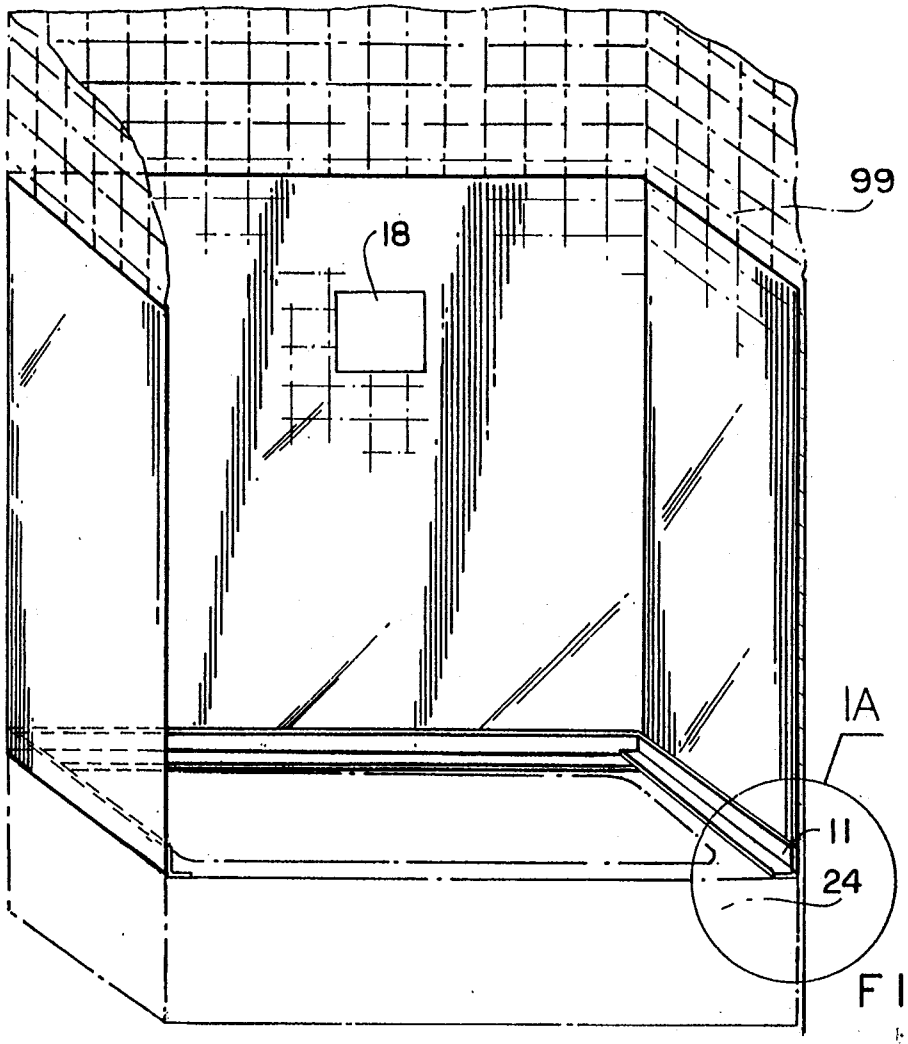

In the most preferred embodiment of this invention, 3 mil polypropylene film is corona-treated to improve adhesion properties for laminating and printing applications during or after the blown film or cast film extrusion processes. With the extruded film at full web width it preferably has a 2 inch wide, 2 mil thick, gold colored, chrome colored or brass colored, aluminum alloy 1145 foil material, laminated to one of the bottom edges of the film with an adhesive: which is well known to the laminating trade. After the film is foil laminated, it is J-folded twice, along its latitudinal axis for size reduction. To J-fold the film it is placed on an unwind stand and off-set 2 inches from the center of the bottom of a V-frame folding machine. This film is then drawn down and along this V-frame folding machine and latitudinally folded almost in half. This folding method leaves a top layer of film completely isolated from all other layers of folded film and this facilitates set up of the liner. The J-folding process is performed again, exactly as it was the first time, and the latitudinally folded film is reduced in size approximately 75% and cut to lengths appropriate for its end-use application.

Aluminum Alloy 1145 is an excellent metal foil, it's lightweight, relatively inexpensive and recyclable. The permanently deformable conforming nature of aluminum alloy 1145 enables it to be latitudinally dead-folded to impart rigidity and then further corner-folded to impart structural strength.

The liner is of sufficient length that it will be usable in the majority of industry standard, 5 foot, tub/shower enclosures, and various sized shower stalls. An industry standard sized, 5 foot, tub/shower enclosure measures approximately 60 inches in length, with two end walls each measuring approximately 30 inches in length; (these two end walls equal 60 inches). The length of the three walls equals 120 inches. A few additional inches may be added for fitting and trimming purposes. In the most preferred embodiment, the shower wall liner used to cover shower walls above a tub, or the walls of a shower stall, is 10 feet long.

In the most preferred embodiment, a shower wall liner used to cover upper walls above a tub is 65 inches tall. A shower wall liner used to cover the upper walls of a shower stall is preferably 77 inches tall.

The shower wall liner used in an institutional setting, such as a military, factory, athletic or other facility is 77 inches tall and may be up to 50 feet long. Since the height and length dimensions will vary to some extent, it is apparent that liners would have to be made appropriate to the overall length/height of a variety of different types of shower stall enclosures.

The shower wall liner is J-folded and wound for the end-use consumer, so that it may be easily unrolled from left to right, or right to left, and unfolded forwardly and downwardly. Changes in J-folding the film enable the liner to be unrolled forwardly and downwardly or forwardly and upwardly. The preferred embodiment employs J-folding for the following benefits:

Firstly, all layers of folded film unfold forwardly and downwardly. This facilitates set up.

Secondly, J-folding allows a single upper layer of film to remain isolated from all other layers of film. This facilitates fastening.

Thirdly, this is an efficient and cost effective method since each time the film material is folded, in the converting process, production costs rise.

Fourthly, this provides a very uniform thickness of film and facilitates rewinding, either by hand or by machine.

After basic converting has been completed, the folded film may be rewound, (for the household sized, 10 foot long, shower wall liners), onto preferably 1.5 inch diameter cores. The core preferably extends 4 inches beyond the width of the folded layers of film and serves as a handle in applying this liner to the shower walls. By rewinding the material onto such a core, the liner is now easy to handle and the consumer unwinds only as much of the liner as he/she can handle at one time while fastening. However, it is important to note that the liner may be wound up by hand to reduce its overall dimensions and be unrolled just as easily onto the shower walls as when it is machine wound on a core. Because either side of the liner may be used, the latitudinally folded film, (not wound on a core), may be wound by hand by the enduse consumer in either a clockwise or counter-clockwise direction. This enables a right handed or left handed person to unwind the liner onto the upper shower walls for fastening in the direction that is most comfortable.

The liner is set up to cover the walls above a tub or the walls of a shower stall, by unrolling it onto the upper portion of the shower walls and fastening the top of the liner by an appropriate means. An effective means of fastening the top of this liner to the walls of a shower is found in U.S. Pat. No. 5,003,647 which uses pairs of releasably attached, magnetically attractable members, having contrasting upper sloping surfaces which force the uppermost portions of this liner in very close contact with the shower walls. There are a variety of fastening methods which are well known; any method which facilitates fastening the top of the liner to the shower walls is acceptable. The art of U.S. Pat. No. 5,003,647 for example is followed, with contrasting upper sloping surfaced members. However, instead of using magnetic attraction to hold the top of the liner, a threaded screwlike shaft is used to fasten these two contrasting upper sloping surfaced members, (not shown). In this example, contact between liner and fasteners is mechanical, not magnetic, by first piercing a hole through this liner, with the tip of the threaded screw-like shaft of the unmounted member, and then screwing this threaded screw-like shaft into the corresponding threaded portions of the wall mounted member. Since the tip of the threaded screw-like shaft in the unmounted member pierces a hole in the liner for fastening, it would also eliminate the need for apertures along the top of this liner.

There are other fastening methods available and they include such methods as wall mounted hooks, hook and loop material such as Velcro, suction cups, clothespin-like devices, vertically spaced strips of releasably attached adhesive tape, and various other continuous or discontinuous, mechanical/adhesive methods. As previously noted, any means of attachment which facilitates set-up of the shower wall liner to the upper portion of the shower walls is acceptable.

When replaceable fastening methods are used to fasten the top portion of the liner to the shower walls, (as opposed to permanent wall mounted mechanical fastening methods), it is important to fasten the top of this liner at a height above the sill of the tub, or floor of the shower stall, which enables the structurally rigid contained framework to lay flat on the sill or floor of the shower enclosure. So that top portions of the liner are always fastened at the correct location, above the sill of the tub, or floor of the shower stall, a user of the liner merely cuts a small, 1 inch wide section of J-folded liner, dead-folds it into the "L-shaped" member, and then places the bottom of this "L-shaped" member on the sill of the tub or floor of a shower stall. A mark is made on the upper shower walls when the top of the liner is reached. This process is repeated until enough marks are made that serve as horizontal fastening guides which show a person setting up a liner exactly where the top is to be fastened, to maintain horizontal alignment. In addition to these markings, grout lines and J-folded film lines serve as horizontal and vertical guides. When wall mounted fasteners are used, this procedure is not necessary because these fasteners are permanently, vertically placed. Once the structurally rigid framework of the liner has been fabricated, the liner is then fitted over plumbing hardware. Any method of opening the liner may be used to access the water controls, the spigot or soap dish, etc. Since thin polyolefin film is so elastic, incisions are made in the film for openings which allow access to plumbing hardware. The film is then stretched over the hardware to create a tight seal.

To operate water controls in the shower enclosure it is necessary to make openings in this liner that enable the controls to pass through and beyond the liner to be accessible. For a most effective seal, the plates which cover standard water control devices may be easily removed by unscrewing the few screws that secure them to their plumbing hardware. Once these water control cover plates have been removed, only the smallest of openings in the thin elastic film need to be made. The liner is then stretched over these protrusions and the covers are screwed back into place. The method yields an effective seal, it is very neat in appearance, once the plates are returned, and it can protect the screws which fasten the cover from rusting by wrapping around the threads of the screw when the cover plate is resecured.

After this liner is unrolled, unfolded, aligned and fitted as required, the end-use consumer first, runs a fingernail, fingertip or other suitable device, along the metal foil once, to latitudinally dead-fold the foil into an "L-shaped" member that is rigid and then second, further corner-folds portions of this "L-shaped" member into three-dimensional, structurally strong members.

These latitudinal dead-folding and corner folding operations collectively form the structurally rigid contained framework of this invention.

It is to be noted, that one of the two legs of the rigid, "L-shaped" bottom reinforcing member may be longer than the other. In the most preferred embodiment the horizontal leg, on the sill of a tub or floor of a shower stall, is 1 and $\frac{1}{4}$ inches long. The vertical leg against the shower wall is $\frac{3}{4}$ inch long. Leg lengths are varied to affect rigidity in one of the two planes, As previously noted, there are at least three corner-folding methods which may be used to produce the structurally strong, three-dimensional corner members.

The basic method is the "Scrunch Method", which squashes and crushes the converging projecting drip edge portions of the rigid, "L-shaped" member, to form three-dimensional, structurally strong corner members. This is not shown.

Figure 2A:
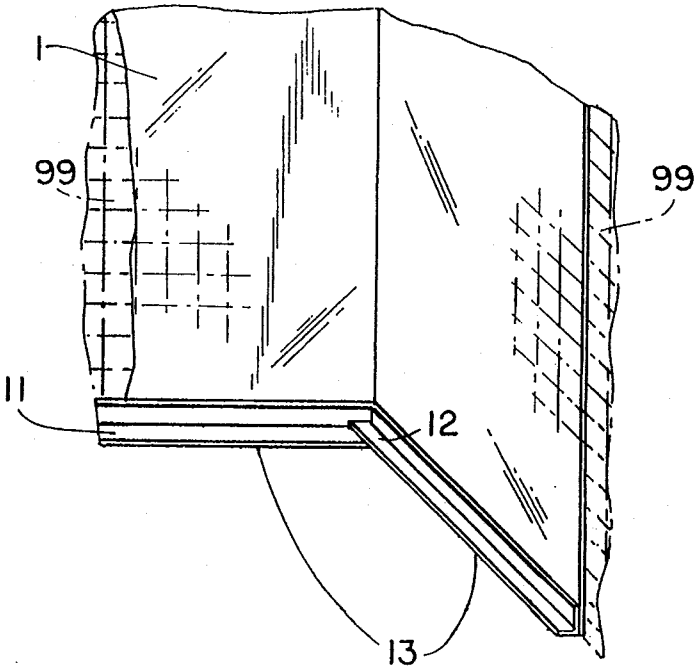
FIG. 2 is an expanded perspective view of the open bottom, shower wall liner 1; covering the shower walls 99: of a shower stall and shows the structurally rigid contained framework 13: the rigid, "L-shaped bottom reinforcing member 11: one of the three-dimensional corner members 12: produced by using the Mitered Cut Method" and the mirror 18.
Figure 2:
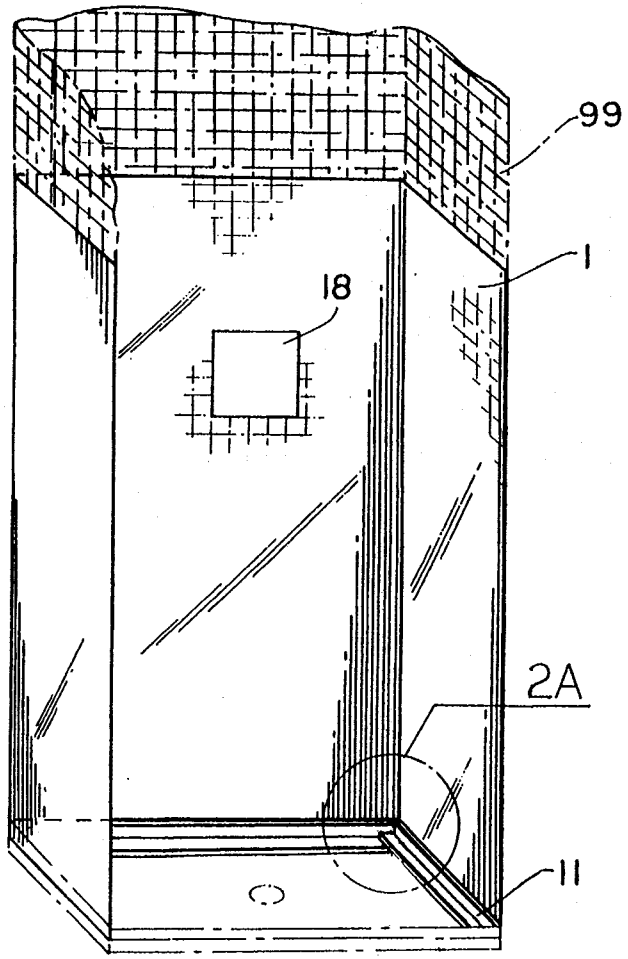

The next method, the "Mitered Cut Method", produces a significantly more rigid and structurally strong three-dimensional member, and entails making an approximately 1 inch long, 45 degree incision, (relative to the corners of the shower walls), in the rigid, "L-shaped" reinforcing bottom member where the cut edges overlap each other and are further rigidified from their contact with the rigid shower walls, to yield an enhanced three-dimensional corner member that is much stronger than the corner member formed by the scrunch method. The Mitered Cut Method is shown in FIG. 2.

Figure 3:
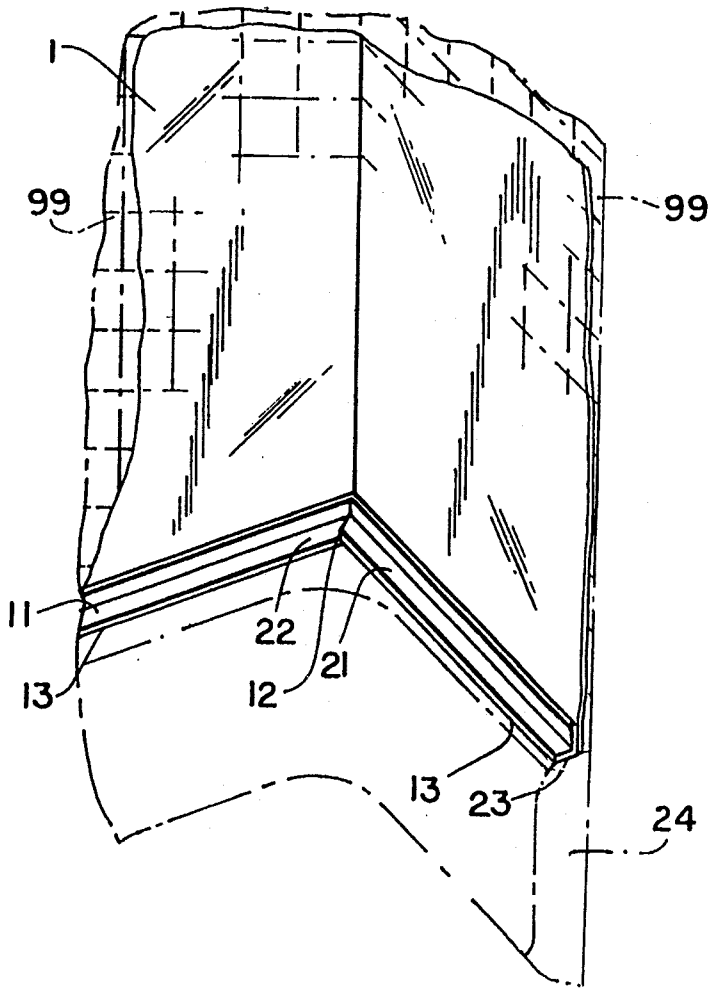
FIG. 3 is a fragmentary perspective view of the open bottom, shower wall liner 1; showing the structurally rigid contained frame 13; collectively formed from a rigid, "L-shaped" bottom reinforcing member 11; and a three-dimensional corner member 12; which has been formed by use of the "Mitered Fold Method", where the converging upwardly and outwardly projecting, end wall drip edge portion 22; of the "L-shaped" member 11; has been rotated 90 degrees horizontally, and is under the sidewall drip edge leg 21; The two are dead-folded and the end wall drip edge leg 22: and side wall drip edge leg 21; lie flat upon the sill 23; of the tub 24.

Finally, there is the "Mitered Fold Method", which produces the strongest, three-dimensional corner member, because the upwardly and outwardly projecting, corner converging, drip edges (of the "L-shaped" member) are not cut. Instead, one is folded so that it ends up underneath the other as the three-dimensional member is being formed. When the mitered fold method is used, a substantially stronger, three-dimensional corner member is produced. Instead of scrunching or cutting this "L-shaped" member, it is further folded at a 45 degree angle relative to the shower walls. This is shown in FIG. 3, where the end wall drip edge leg 22; of the "L-shaped" bottom reinforcing member 11; is folded at a 45 degree angle, relative to the 90 degree angle of the side wall drip edge leg 21. Corner-folding or mitering the "L-shaped" reinforcing member in the opposite direction produces a three-dimensional corner member which is of equal structural strength.

When the rigid, "L-shaped" bottom reinforcing member, and three-dimensional corner members are formed, lower portions of the liner become so structurally rigid that billowing, shifting sideways liner motion, and film clinging to the skin are eliminated.

If use of the soap dish is desired, it is easily accessed by incising the liner and affixing the incised edges of the liner to portions of this soap dish with a magnetic, adhesive or mechanical means, (which are well known and not shown).

In a second embodiment, the art of the preferred embodiment is followed, however, the permanently deformable conforming metal foil used, is any metal foil which is bound to the film. The metal foil used may be a copper alloy, a hard or soft aluminum material or a variety of permanently deformable conforming materials.

In a third embodiment, a 2–3 mil, polyethylene film is used, since it is less expensive than polypropylene and excluding the higher haze level has acceptable properties for the invention especially if color tinted.

In a fourth embodiment, biodegradable or photodegradable films, or mixtures of reclaim and/or recycled polyolefins with virgin polyolefins are used.

In a fifth embodiment, the liner is made out of a 3 mil polyolefin film that is transparent, translucent opaque, textured, printed upon, colored or color tinted. This embodiment anticipates decorative and advertising uses.

In a sixth embodiment, the liner can be wound for the end-use consumer, so that all layers of folded film unroll from right to left, in a clockwise direction and unfold forwardly and downwardly, (not shown), or the the liner can be folded and wound for a consumer so that the liner unfolds forwardly and upwardly, in a clockwise or counter-clockwise direction. (not shown). Here, the user starts at the bottom of shower wall and unfolds upwardly as opposed to unfolding downwardly. This entails different initial latitudinal dead folding methods after extrusion, (not shown). These methods are well known in the extrusion industry.

In a seventh embodiment a permanently deformable conforming metal foil is laminated to the bottom of the limp polyolefin film, as a final step in the converting process. The liner is first folded in half, (known as Center Folding or U-Folding in the extrusion trade, (and is not shown). It is then J-folded and then C-folded, which folds over 1 of the 2 top edges of U-folded film, not shown. When these folding operations are completed the foil is laminated onto the face side of the C-folded layer, (not shown). When the liner is converted in this method and unfolded onto the shower walls the foil is at the bottom of the shower walls and is latitudinally dead folded and corner-folded as described, but done prior to fastening the top of the liner to the shower walls.

In an eighth embodiment, the shower wall liner intended for use in institutional applications may be up to 50 feet long to yield an uninterrupted length of liner as required by the end-use application since institutional applications contain more than one shower.

In a ninth embodiment, a flexible, anti-fogging, hydrophillic coated, mirror-like device 18 is removably attached with a well known fastening means, to a portion of this liner, and is used for shaving or other viewing purposes, In contrast to rigid mirrors which fog-up and bead water, (when placed in the steamy environment of a shower), the anti-fogging, hydrophillic coated surface of this mirror-like device will not fog-up or bead water when used in the shower. The device is a lamination of two materials, the first, a preferably 2–3 mil thick, gold or chrome colored, mylar film, and the second, a preferably 1–2 mil thick, anti-fogging, hydrophillic coated, PET film. The two films are laminated with an acrylic adhesive, (well known in the laminating trade), so that the anti-fogging, hydrophillic coated side, (of this flexible mirror-like device), may be exposed to the steamy environment of a shower. The surface of this flexible, anti-fogging, hydrophillic coated, mirror-like device remains fog free and also sheets water, (instead of beading water), when placed in The shower. The term: "sheets water", means that the surface of this flexible, mirror-like device is fully wetted. Beads, or droplets of water do not form on this device. It is to be noted, that some rigid mirrors do have anti-fog properties, but they are not hydrophillic coated. Beads of water form and fogging occurs on these rigid mirrors which distorts the reflected image.

In a tenth embodiment, the permanently deformable foil material is placed at the bottom of an elastic polyethylene sheet, where the sheet consists of two layers which are heat—adhesively attached to each other, and which encapsulate the foil material at the bottom of the polyethylene sheet. It is noted, that this encapsulated sheet can also be made by direct extrusion of the polymer on both sides of a foil material or by coating a plastic sheet and the foil to encapsulate it.

In the last embodiment, the plastic sheet is modified by addition of 0.05 to 2 parts per hundred of a biocidal material to the plastic as it is extruded into sheet. The biocide material may be any of a variety of known biocides which are partly soluble in the molten plastic which exude to the surface as the plastic ages.

I claim:

1. A liner system for use with a shower enclosure having at least two substantially perpendicular vertical walls abutting a substantially horizontal surface at bottom edges thereof, comprising:

a sheet of non-metallic waterproof film sized to cover said walls; and a strip of metal foil secured exclusively along a bottom edge portion of said sheet, said strip being creasable longitudinally forming a substantially "L-shaped" bottom edge of said sheet to conform to the juncture of said vertical walls and horizontal surface, said strip further being deformable laterally forming two substantially perpendicular portions to conform to the juncture of said vertical walls, whereby said sheet may be secured to said walls to protect the same.

2. The liner system in claim 1; where said film is a polyolefln film.

3. The liner system in claim 1 where said film is 1–4 mils and said foil is 1.5–4 mils.

4. The liner system in claim 1; where said foil strip is 1–4 inches wide.

5. The liner system in claim 1; where the legs of said "L-shaped" bottom edge are each at least ½ inch wide.

6. The liner system in claim 1; where said foil strip laminated to said film.

7. The liner system in claim 1; where said film contains biocidal means for inhibiting biological growths.

8. The liner in claim 1; where the modulus of elasticity of said foil strip is greater than 40 (GPa).

9. The liner system in claim 1; which additionally has a removably attached, anti-fogging, hydrophillic coated, flexible, mirror-like device attached to said sheet.

10. The liner system in claim 1; where said horizontal surface is a sill of a bathtub.

11. The liner system in claim 1; where said horizontal surface is a floor of a shower.

* * * * *